United States Patent [19]

Berney

[11] 3,967,442

[45] July 6, 1976

[54] ELECTRIC WATCH HAVING AN ELECTROMECHANICAL MOVEMENT INCLUDING A CORRECTION MECHANISM FOR SMALL ERRORS

[76] Inventor: Jean-Claude Berney, Chemin de la Croix-Rouge 2, Lausanne, Switzerland

[22] Filed: July 14, 1975

[21] Appl. No.: 595,687

Related U.S. Application Data

[63] Continuation of Ser. No. 438,455, Jan. 31, 1974, abandoned.

[30] Foreign Application Priority Data

Feb. 1, 1973 Switzerland ..... 1418/73

[52] U.S. Cl. ..... 58/23 R; 58/85.5

[51] Int. Cl.[2] ..... G04C 3/00

[58] Field of Search ..... 58/23 R, 23 A, 23 AC, 58/23 D, 23 TF, 23 V, 50 R, 28 R, 28 B, 85.5; 318/120, 127

[56] References Cited

UNITED STATES PATENTS

| | | | |
|---|---|---|---|
| 3,553,957 | 1/1971 | Dome et al. | 58/23 A |
| 3,756,014 | 9/1973 | Zatsky et al. | 58/28 R |
| 3,777,471 | 12/1973 | Koehler et al. | 58/85.5 X |
| 3,795,098 | 3/1974 | Fujita | 58/85.5 |
| 3,812,669 | 5/1974 | Wiget | 58/23 R |
| 3,895,486 | 7/1975 | Hammer et al. | 58/23 R |

*Primary Examiner*—Ulysses Weldon
*Attorney, Agent, or Firm*—Haseltine, Lake & Waters

[57] ABSTRACT

An electric watch comprising a precise resonator, connected to an oscillator to which a frequency divider is connected. A control device is connected to the watch movement and to the frequency divider for controlling the watch movement to eliminate small errors in indicated time. The control device comprises a first counter synchronized in operation with the watch movement and a second reference counter connected to the divider, a comparator being connected to the counters for comparing the states thereof and coupled to the watch movement for maintaining the counters in phase while varying the speed of the watch movement. The second reference counter can be set to a predetermined state independent of the first counter from outside the watch. In one embodiment the watch movement includes a step motor supplied with impulses from the divider, the comparator being connected to the step motor to act on the frequency of the impulses supplied by the divider to vary the speed of the motor until the first and second counters are equal. In a second embodiment a motor coil serves for applying energy to the watch movement to vary its speed of operation, the motor coil being connected to the comparator to be controlled thereby to effect speed change of the watch movement until the counters are equalized.

7 Claims, 3 Drawing Figures

ELECTRIC WATCH HAVING AN ELECTROMECHANICAL MOVEMENT INCLUDING A CORRECTION MECHANISM FOR SMALL ERRORS

CROSS-RELATED APPLICATION

This application is a continuation of copending application Ser. No. 438,455 filed Jan. 31, 1974 now abandoned.

BACKGROUND

1. Field of the Invention

The invention relates to electric watches having an electromechanical movement and particularly to such watches including means for correcting relatively small errors of the order of magnitude of 30 seconds or less.

2. Prior Art

There are presently known electronic watches with quartz oscillators in which electromechanical means are employed to drive the watch movement, i.e. a step motor driving a wheel, or a rotating motor with a synchronized hairspring balance. It has also been proposed to utilize a generator driven by a spring and synchronized by an electronic circuit containing the quartz oscillation. See, for example, my earlier application Ser. No. 417,588 filed Nov. 20, 1973. In all of these types of watches, the resetting of the time is difficult and the user can not easily avoid committing errors. Accordingly, the user often ignores resetting the time when the error is less than thirty seconds. However, the quartz oscillator gives to the watch a precision of this order of magnitude.

SUMMARY OF THE INVENTION

An object of the invention is to provide an electronic watch with means capable of easily correcting errors of less than thirty seconds with elimination of the need to reset the time, except at the time when the watch is started.

The watch according to the invention is of the type comprising a precision resonator, an oscillator, a frequency divider, an electromechanical watch movement, control means for controlling or synchronizing the watch movement.

The watch of the invention is characterized in that it includes a counter A synchronized with the electromechanical watch movement, a reference counter B fed by a divider, comparator means connected to counters A and B and acting, on the basis of the states of the counters, on the control means to keep and maintain the counters A and B in phase while varying the speed of the watch movement, and means for putting counter B in a predetermined state independent of counter A, this latter means being acted on from the exterior of the watch and optionally being combined with the means for resetting the time or for correction of the date.

DETAILED DESCRIPTION

Figure 1:
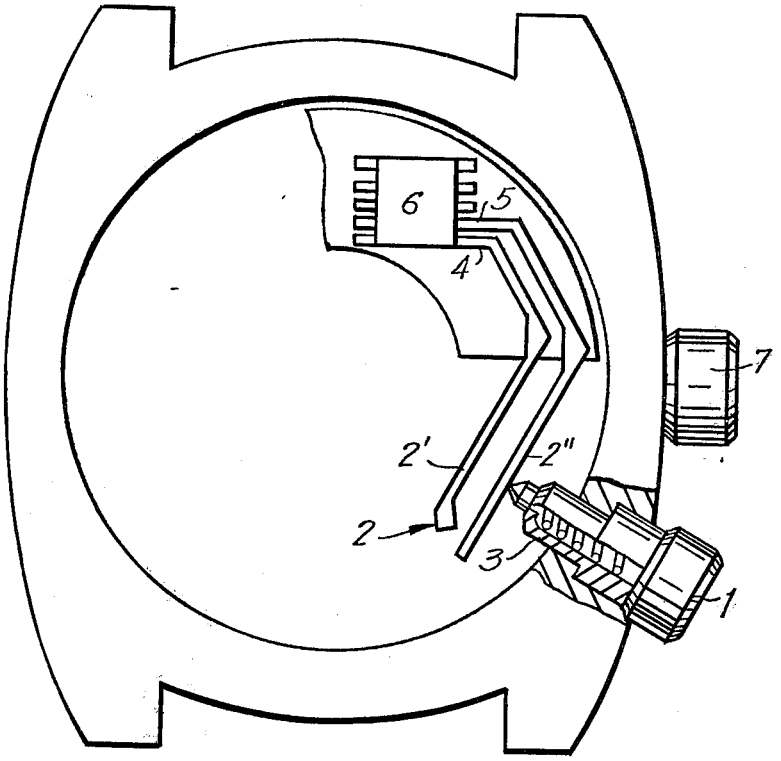
FIG. 1 is a diagrammatic illustration, partly in section, of an electronic watch with means for resetting counter B.

Referring to FIG. 1, therein is diagrammatically shown a watch casing have a push button 1 which when depressed closes the contacts 2′,2″ of a switch 2. The contacts 2′,2″ are electrically connected to the terminals 4,5 of an electronic circuit 6 whose construction will be described later with reference to FIGS. 2 and 3. A return spring 3 acts on push button 1 to urge it to its initial position to open switch 2 when the push button is released. The watch includes a stem 7 by which the hands can be reset to any desired time. It is possible to construct stem 7 in such a way that it will behave in the manner of pushbutton 1 so as to control switch 2.

Figure 2:
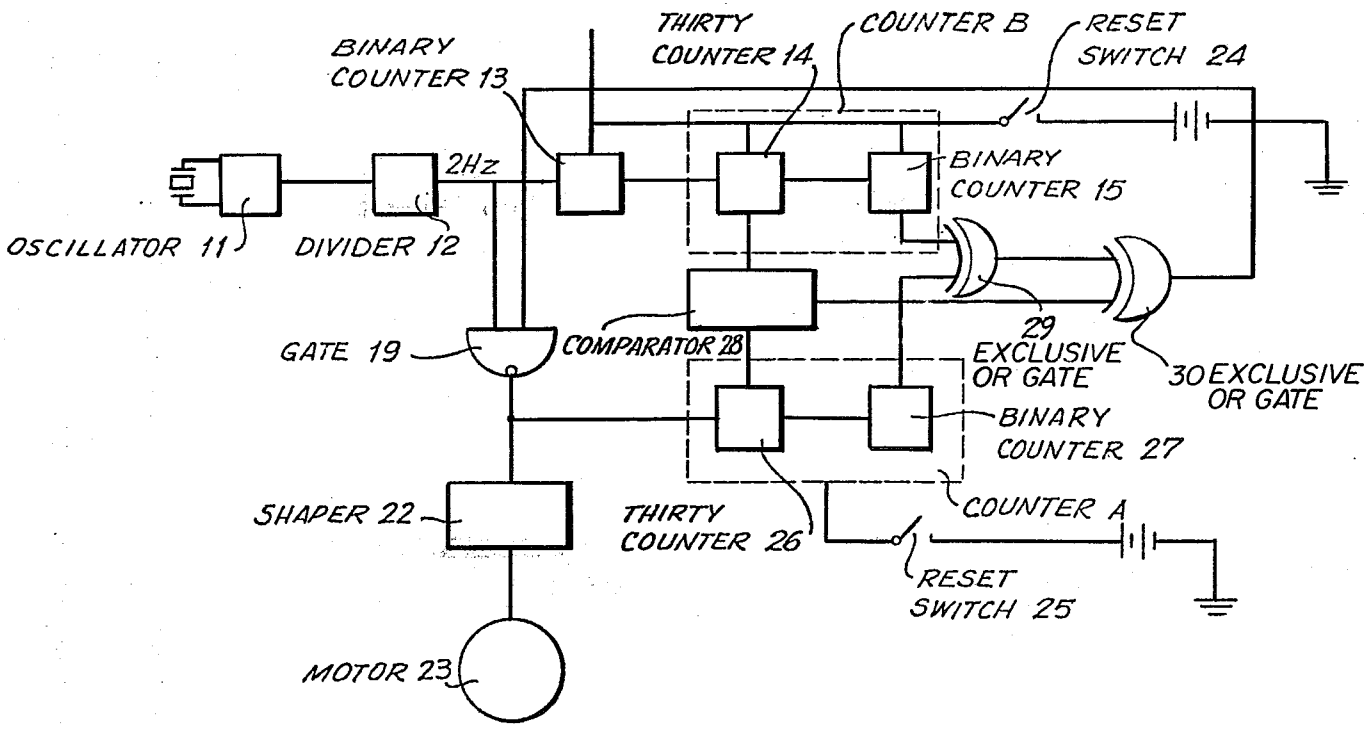
FIG. 2 is a diagrammatic illustration of an electronic circuit for a watch including a step motor driving the gear mechanism of a watch movement.

Referring to the embodiment of FIG. 2 of the electronic circuit, therein is seen a quartz resonator or other precise resonator connected to an oscillator 11 which is in turn connected to a frequency divider 12 which delivers impulses at a frequency of 2Hz. These impulses are fed to a counter by two's i.e. a binary counter 13 and then to a reference counter B constituted by a counter by thirty 14 or referred hereafter simply as a "thirty" counter which produces a signal when thirty impulses have been fed thereto, and a binary counter 15 connected to counter 14. The period of the output of the latter counter is 60 seconds.

The impulses at the output of divider 12 are also fed to a gate 19 which when open passes the impulses to a shaper 22 of the impulses for a step motor 23 and to a counter A. Each time that the motor 23 receives an impulse from shaper 22 and advances one step, the counter A counts one impulse. The counter A is therefore synchronized with the motor 23 and thereby with the watch movement which is driven by motor 23. Therefore, the state of counter A can be made to coincide with the 00 position of the second hand of the watch movement by means of the reset switch 25 for counter A.

The counter A is constituted, similarly to counter B, by a thirty counter 26 and a binary counter 27. The state between counters A and B is determined by a comparator 28, of any suitable well known type (e.g. National Semiconductor Form's DM8200), which detects the states, $A<B$ or $A \geqq B$, and two OR gates 29, 30. This arrangement acts on gate 19 such that it is blocked when A  B i.e. when counter A is ahead of counter B. The 2Hz impulses are no longer fed to shaper 22 or counter A which are thus stopped. The counter B, in contrast, receives impulses of 1Hz from counter 13. Its state increases until $A=B$. In the other case when $A<B$ the impulses of 2Hz are fed to shaper 22 and to counter A. As the frequency is twice that applied to counter B, the counter A advances with respect to counter B up to the time when $A=B$. Then, there is synchronization between the counters A and B. Since the counter A is already synchronized with motor 23 and the watch movement, it can be said therefore, at equilibrium, that the counters A and B and the watch movement are synchronized, i.e. when the second hand passes position 00, the counters A and B are at 0.

Assuming the watch to be 15 seconds slow, when, the counters A and B are at 45, the second hand is at the 45 second position and if the reset switch 24 of counter B is closed this will shift counter B to 00 and the phase comparator 28 will react and open gate 19 to introduce the double frequency 2Hz to motor 23 and counter A.

The motor 23 and counter A progress at a double speed up to the time when counter A catches up to counter B. This will occur 15 seconds after the reset switch 24 of counter B has been depressed and during such time the motor 23 will have driven the watch movement through the equivalent of 30 seconds of time to compensate for the initial 15 seconds which the watch was slow.

If the watch is fast by 15 seconds, when counters A and B are at 15 and the second hand is at the 15 second position, the reset switch 24 of counter B will be closed, this will shift counter B to 00. The comparator 28 reacts to stop motor 23 and counter A until counter B has caught up to counter A.

It is seen therefore that the time in the two cases can be reset by acting on the reset switch 24 of counter B (corresponding to switch 2 in FIG. 1), for example, at the instant when a time signal is given and the second hand is to be reset. This setting of the time is registered in counter B, then transmitted via the operation of comparator 28 and the logic elements to motor 23 and to counter A.

Therefore, by the simple action on a push button, it becomes possible to eliminate small errors of less than 30 seconds and therefore maintain the time of the watch without need for, resetting the watch mechanism which would involve relatively difficult manipulations.

Figure 3:
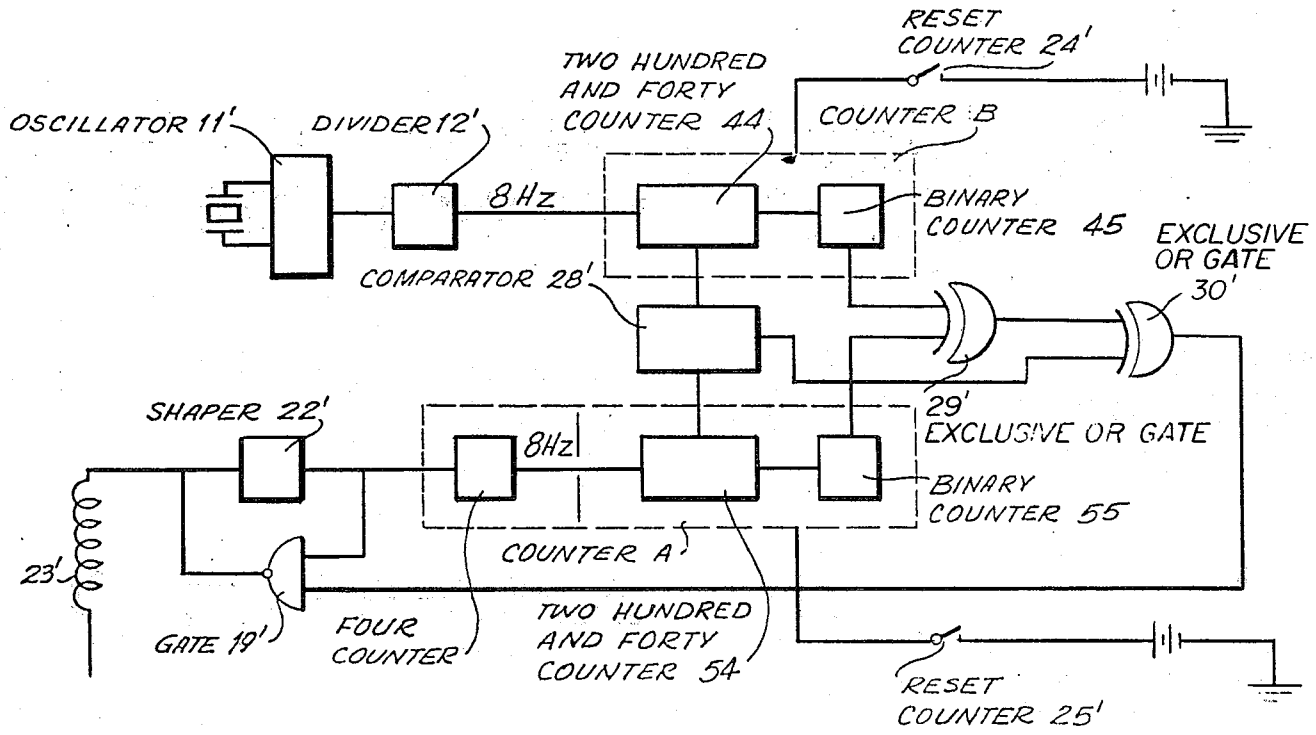
FIG. 3 is a diagrammaic illustration of an electronic circuit including a motor associated with a watch movement and whose speed of rotation is dependent on the energy it receives.

Referring to FIG. 3, therein is seen a circuit which can act on a rotating motor or a motor having a synchronized hairspring lever or a generator driven by a spring. Such drive arrangements can be found in my earlier application, Ser. No. 417,588 filed Nov. 20, 1973. In this embodiment the induced voltage in coil 23' of the motor acts on counter A.

In FIG. 3 similar elements to those in FIG. 2 will be given the same numerals but with primes. In this embodiment, the divider 12' produces an output signal of a frequency of 8Hz. The states of the counters A and B are compared in comparator 28' and exclusive OR gates 29' and 30'. The counters A and B include counters by two-hundred and forty 44 and 54, respectively, and respective binary counters 45,55. The period of the output is 60 seconds. The phase comparator 28' acts on gate 19' such that when A ≥ B i.e. when A is ahead of B, the gate is opened and the energy transmitted to the coils of motor 23' is reduced and thereby its speed whereby the energy subtracted at the terminals of the drive of the watch movement is increased (see my aforesaid applicaton for a detailed explanation). Hence, the watch movement will be slowed until A=B at which time gate 19' is closed. Conversely, when A<B i.e. when A is behind B, the energy transmitted to the coils of motor 23' is increased and thereby its speed whereby the energy subtracted at the terminals of the drive of the watch movement is reduced. Hence, the watch movement will be speeded up until A=B at which time gate 19' is closed. In this manner, the counter A and thereby the watch movement, are maintained in phase with counter B.

When one resets counter B to the actual time, this acts on the motor and on the counter A up to the time when these elements are resynchronized with counter B. They therefore set themselves to the time.

What is claimed is:

1. An electric watch comprising a precise resonator, an oscillator coupled to said resonator, a frequency divider connected to the oscillator, a watch movement including drive means therefor and means coupled to the frequency divider and the drive means of the watch movement for controlling the operation thereof to eliminate errors in indicated time, the latter means comprising a first counter coupled for synchronized operation with said drive means of the watch movement, a second reference counter connected to said divider, comparison means connected to said counters for comparing the states thereof and coupled to said drive means of the watch movement for maintaining the counters in phase while varying the speed of the watch movement, and first and second reset means for respectively setting the said first and second counters independently of each other from outside the watch.

2. An electric watch as claimed in claim 1 wherein said drive means of the watch movement includes a step motor coupled with and periodically supplied with impulses from said divider, gating means for selectively passing impulses from said divider to said drive means of the watch movement, said comparison means being connected to said gating means to act thereon to control the feed of impulses from the divider to the motor to adjust the speed of the motor until the first and second counters are equal.

3. An electric watch as claimed in claim 2 wherein said comparison means comprises a comparator connected to said first and second counters and a pair of exclusive OR gates the first being connected to said first and second counters and the second to the output of the first exclusive OR gate and to said comparator, said gating means comprising a further gate connected between said motor and said divider, said further gate being connected to and controlled by said second exclusive OR gate.

4. An electric watch as claimed in claim 3 said first and second reset means comprising reset switches respectively connected to said first and second counters to reset the same to zero.

5. An electric watch as claimed in claim 1 wherein said means for controlling the drive means of the watch movement comprises means for applying energy to said drive means to vary the speed of operation thereof, this said means also receiving impulses from said drive means and feeding the same to said first counter and back to said drive means under the control of said comparison means to effect speed change of the watch movement until the first and second counters are equalized.

6. An electric watch as claimed in claim 5 wherein said comparison means comprises a comparator connected to said first and second counters and a pair of exclusive OR gates, the first being connected to said first and second counters and the second to said comparator and to the output of the first exclusive OR gate, and a further gate connected to said drive means and to said second exclusive OR gate.

7. An electric watch as claimed in claim 6 comprising reset switches respectively connected to said first and second counters to reset the same to zero.

* * * * *